US007073878B2

(12) United States Patent
Nishida et al.

(10) Patent No.: US 7,073,878 B2
(45) Date of Patent: Jul. 11, 2006

(54) LIQUID EJECTING APPARATUS AND CONTROLLING UNIT OF LIQUID EJECTING APPARATUS

(75) Inventors: Keisuke Nishida, Nagano-Ken (JP); Junhua Chang, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 10/673,455

(22) Filed: Sep. 30, 2003

(65) Prior Publication Data

US 2004/0212646 A1 Oct. 28, 2004

(30) Foreign Application Priority Data

Sep. 30, 2002 (JP) ..... 2002-286271
Sep. 30, 2002 (JP) ..... 2002-286289

(51) Int. Cl.
*B41J 29/38* (2006.01)
*B41J 2/05* (2006.01)

(52) U.S. Cl. ..... 347/10; 347/11; 347/57

(58) Field of Classification Search ..... 347/10–11, 347/19, 57, 68, 69, 72
See application file for complete search history.

(56) References Cited

U.S. PATENT DOCUMENTS 5,371,520 A 12/1994 Kubota
5,453,767 A * 9/1995 Chang et al. ..... 347/10
6,217,159 B1 4/2001 Morikoshi et al.
6,312,077 B1 * 11/2001 Araki ..... 347/11
6,382,754 B1 5/2002 Morikoshi et al.

FOREIGN PATENT DOCUMENTS

EP 0700783 A2 3/1996
EP 0738602 A2 10/1996
EP 0841164 A1 5/1998
EP 0858892 A1 8/1998
EP 1 038 677 A1 9/2000
JP 56-113473 9/1981
JP 01-275148 11/1989
JP 01-278358 11/1989
JP 01-297258 11/1989
JP 8-300646 A 11/1996

(Continued)

*Primary Examiner*—Thinh Nguyen
(74) *Attorney, Agent, or Firm*—Sughrue Mion, PLLC

(57) ABSTRACT

A liquid ejecting apparatus of the invention includes: a pressure-generating chamber having an inside space whose volume is changeable, into which a liquid is supplied and which is communicated with a nozzle, a resonance frequency of said pressure-generating chamber having a period of Tc; a signal-generating unit that generates a driving signal having: a first signal-element for causing the pressure-generating chamber to expand, a second signal-element for causing the pressure-generating chamber to contract from an expanding state thereof in order to eject a drop of the liquid through the nozzle, and a third signal-element for causing the pressure-generating chamber to expand to an original state before outputting the first signal-element after the drop of the liquid is ejected; and a pressure-generating unit that causes the pressure-generating chamber to expand and contract, based on the driving signal. The third signal-element has: a first-step element for causing the pressure-generating chamber to expand to an intermediate contracting state, which is smaller than the original state before outputting the first signal-element; and a second-step element for causing the pressure-generating chamber of the intermediate contracting state to the original state before outputting the first signal-element. The first-step element and the second-step element are substantially discontinuous in at least one of applying time or inclination.

15 Claims, 4 Drawing Sheets

FOREIGN PATENT DOCUMENTS

| | | | |
|---|---|---|---|
| JP | 9-52360 | A | 2/1997 |
| JP | 10-024570 | | 1/1998 |
| JP | 10-286961 | A | 10/1998 |
| JP | 2000-272146 | | 10/2000 |
| JP | 3225987 | B2 | 8/2001 |
| WO | WO 97/37852 | A1 | 10/1997 |

* cited by examiner

LIQUID EJECTING APPARATUS AND CONTROLLING UNIT OF LIQUID EJECTING APPARATUS

FIELD OF THE INVENTION

This invention relates to a liquid ejecting apparatus wherein for example a piezoelectric vibrating member is used as an actuator.

BACKGROUND OF THE INVENTION

A head member of a liquid ejecting apparatus, such as a recording head of an ink-ejecting recording apparatus, has a pressure-generating chamber which is communicated with a nozzle and which is partly formed by an elastic plate. A movable end of a piezoelectric vibrating member is joined to the elastic plate. The piezoelectric vibrating member can expand and contract. Thus, a volume of the pressure-generating chamber can be changed by causing the piezoelectric vibrating member to expand and contract. As a result, ink can be supplied into the pressure-generating chamber and a drop of the ink can be ejected from the pressure-generating chamber.

As an actuator for driving such a recording head at a high speed, a longitudinal-mode piezoelectric vibrating member is used, which consists of alternatively stacked piezoelectric material and electric conductive layer and which can extend in a longitudinal direction thereof.

The longitudinal-mode piezoelectric vibrating member needs a smaller area in order to join to the pressure-generating chamber than a bending-type piezoelectric vibrating member does. In addition, the longitudinal-mode piezoelectric vibrating member can be driven at a higher speed. Thus, a printing operation can be achieved with a finer resolution (definition) and at a higher speed.

However, although such a longitudinal-mode piezoelectric vibrating member can be driven at a higher speed, a reducing rate (damping rate) of remaining vibration (residual vibration) thereof is smaller. Thus, larger remaining vibration may be remained after a drop of the ink has been ejected, which may affect behavior of a meniscus of the ink. For example, if a position of the meniscus remains disordered when a next drop of the ink is ejected, the next drop of the ink may be ejected in an undesired direction. Alternatively, if the meniscus overshoots a proper range toward the nozzle so much, mist of the ink may be generated i.e. quality of printed images may be deteriorated.

Then, in order to prevent generation of the mist of the ink or the like by reducing (damping) the remaining vibration of the meniscus after the drop of the ink is ejected, the Japanese Patent Laid-Open Publication No.9-52360 has proposed an ink-ejecting recording apparatus. The ink-ejecting recording apparatus is adapted to generate a driving signal PDS including: a first signal-element S51 for causing a pressure-generating chamber to expand, a second signal-element S52 for causing the pressure-generating chamber to contract from an expanding state thereof in order to eject a drop of the ink through a nozzle, and a third signal-element S53 for causing the pressure-generating chamber to expand by a volume smaller than a volume expanded by the first signal-element S51 just when a vibration of the meniscus turns toward the nozzle after the drop of the ink is ejected (see FIG. 6). Thus, the meniscus, which is going to turn toward the nozzle after the drop of the ink is ejected, is pulled back toward the pressure-generating chamber because the pressure-generating chamber is caused to expand by the third signal-element S53. Thus, the vibration of the meniscus can be reduced effectively. Thus, the generation of the mist of the ink, which may be caused by movement of the meniscus, can be prevented. In addition, a position of the meniscus can be adjusted to a substantially regular position when a next drop of the ink is ejected, so that the drop of the ink can be ejected more stably.

With respect to the driving signal PDS shown in FIG. 6, a voltage difference Vc1 of the first signal-element S51, a voltage difference Vd of the second signal-element S52 and a voltage difference Vc2 of the third signal-element S53 satisfy a relationship of Vc1+Vc2=Vd.

The driving signal PDS shown in FIG. 6 is designed as follows.

At first, in accordance with characteristics of ejecting a drop of the ink (ejecting weight of the drop of the ink and/or ejecting speed thereof), the voltage difference Vd of the second signal-element S52 is designed. Then, depending on the voltage difference Vd, in order for adjustment of the voltage level, the voltage difference Vc1 of the first signal-element S51 and the voltage difference Vc2 of the third signal-element S53 are designed. Herein, it is taken into consideration that the third signal-element S53 serves for controlling vibrations of menisci. If the vibrations of menisci are suitably controlled, a drop of the ink can be stably ejected in the next period.

SUMMARY OF THE INVENTION

As described above, the third signal-element S53 serves for controlling the vibrations of menisci. That is, the third signal-element S53 is applied (outputted) to the remaining (residual) vibrations of menisci at a timing to cause the menisci to reversely vibrate.

However, when the amplitude of the third signal-element S53 is too large (when the voltage difference Vc2 is too large), the effect of controlling the vibrations is too much. In the case, as the inventors have found, a column-like ink extending from a meniscus has a longer tail portion, so that behavior (movement) of a satellite drop, which is generated from the longer tail portion, becomes unstable. Specifically, a speed of the satellite drop may become so low that an ejecting direction of the satellite drop may be curved.

Thus, it is preferable to control the voltage difference Vc2 of the third signal-element S53 to a certain level.

On the other hand, when the amplitude of the first signal-element S51 is increased (when the voltage difference Vc1 is increased), if the duration of the first signal-element S51 is maintained, the ejecting speed of a drop of the ink tends to be too high. To the contrary, if the duration of the first signal-element S51 is increased, one period of the driving signal also becomes longer, so that it becomes difficult to drive the ink-ejecting recording apparatus at a high frequency.

In addition, as the inventors have found, when numerous pressure-generating chambers are densely arranged via partitions, if the amplitude of the first signal-element S51 is increased, some pressure-generating chambers that should not be deformed may be easily deformed (cross talk).

Thus, it is preferable to control the voltage difference Vc1 of the first signal-element S51 to a certain level as well.

On the way to this invention, the inventors have studied to provide a fourth signal-element for adjustment of the voltage level before the first signal-element S51 or after the third signal-element S53, in order to independently design the voltage difference Vc1 of the first signal-element S51 and the voltage difference Vc2 of the third signal-element S53.

However, if the fourth signal-element is provided as described above, the period of the driving signal becomes longer, so that it becomes difficult to drive the ink-ejecting recording apparatus at a high frequency.

The object of this invention is to solve the above problems, that is, to provide a liquid ejecting apparatus that can eject a drop of liquid more stably and that can be driven at a high frequency.

This invention is a liquid ejecting apparatus comprising: a pressure-generating chamber having an inside space whose volume is changeable, into which a liquid is supplied and which is communicated with a nozzle, a resonance frequency of said pressure-generating chamber having a period of Tc; a signal-generating unit that generates a driving signal including: a first signal-element for causing the pressure-generating chamber to expand, a second signal-element for causing the pressure-generating chamber to contract from an expanding state thereof in order to eject a drop of the liquid through the nozzle, and a third signal-element for causing the pressure-generating chamber to expand to an original state before outputting the first signal-element after the drop of the liquid is ejected; and a pressure-generating unit that causes the pressure-generating chamber to expand and contract, based on the driving signal; wherein the third signal-element includes: a first-step element for causing the pressure-generating chamber to expand to an intermediate contracting state, which is smaller than the original state before outputting the first signal-element, and a second-step element for causing the pressure-generating chamber of the intermediate contracting state to the original state before outputting the first signal-element, and the first-step element and the second-step element are substantially discontinuous in at least one of applying time or inclination.

According to the invention, expansion of the pressure-generating chamber while the third signal-element is applied (outputted) has at least two steps. Thus, if the expansion step of the pressure-generating chamber by the latter step i.e. the second-step element is designed for controlling vibrations of menisci, the voltage level can be adjusted by means of the former step i.e. the first-step element, that is, the design of the first signal-element is not affected. In addition, differently from a case wherein a fourth signal-element is provided as described above, the length of one period of the driving signal can be easily inhibited within a predetermined range.

Therefore, stableness of behavior of a satellite drop, a suitable ejecting speed of the drop of the liquid and a drive of the liquid ejecting apparatus at a high frequency can be suitably achieved at the same time.

For example, expansion of the pressure-generating chamber by means of the second-step element is started discontinuously to a state of the pressure-generating chamber just before applying the second-step element. Preferably, a middle-step element for causing the pressure-generating chamber to maintain the middle contracting state is provided between the first-step element of the third signal-element and the second-step element of the third signal-element.

In the case, explained is a relationship between a time T1 from an end time of outputting of the second signal-element to an end time of outputting of the first-step element of the third signal-element and a time T2 from the end time of outputting of the second signal-element to an end time of outputting of the second-step element of the third signal-element.

If a relationship of $T1 \approx T2 \times 1/2$ is satisfied between the times T1 and T2, application (outputting) of the first-step element urges further vibrations of the menisci. Thus, it is preferable that a relationship of $T1 \neq T2 \times 1/2$ is satisfied between the times T1 and T2 . In addition, as confirmed through various experiments by the inventors, it is preferable that a relationship of $T1 < T2 \times 1/2$ is satisfied between the times T1 and T2 . More preferably, a relationship of $T1 \leqq T2 \times 1/4$ is satisfied.

In addition, regarding to the time T2, it is preferable that the time T2 is set to be substantially equal to the period Tc of the resonance frequency of the inside space of the pressure-generating chamber.

Alternatively, regarding to the time T2, it is preferable that the time T2 is set to be variable depending on dispersion among respective head members or the like of the period Tc of the resonance frequency of the inside space of the pressure-generating chamber.

Herein, as described above, the first-step element of the third signal-element is an element used for adjustment of the voltage level. However, regarding vibrations caused by application of the first-step element, no particular positive vibration control is taken into consideration. Thus, if such vibrations have a significant magnitude, behaviors of the menisci become unstable.

From the viewpoint of that, as the inventors have found, it is preferable that an amplitude Vp of the first-step element of the third signal-element is equal to or less than 20%, in particular 15%, of an amplitude Vd of the second signal-element.

In addition, if the first-step element and the second-step element are continuous, an inclination of the first-step element until a connecting portion to the second-step element and an inclination of the second-step element after the connecting portion to the first-step element are discontinuous (that is, different from each other).

In the case, as confirmed through various experiments by the inventors, it is preferable that the inclination of the first-step element until the connecting portion to the second-step element is lower than the inclination of the second-step element after the connecting portion to the first-step element.

In addition, as confirmed through various experiments by the inventors, it is preferable that an amplitude Vc1 of the first signal-element is less than 50% of the amplitude Vd of the second signal-element.

In addition, as confirmed through various experiments by the inventors, it is preferable that the amplitude Vp of the first-step element of the third signal-element is less than 40% of the amplitude Vd of the second signal-element.

In addition, as confirmed through various experiments by the inventors, it is preferable that an amplitude Vc2 of the second-step element of the third signal-element is more than 20% of the amplitude Vd of the second signal-element.

In addition, as confirmed through various experiments by the inventors, it is preferable that the amplitude Vp of the first-step element of the third signal-element is equal to or less than the amplitude Vc2 of the second-step element of the third signal-element.

For example, the pressure-generating unit has a piezoelectric vibrating member. In order to eject a plurality of drops of the liquid successively at a high speed, it is preferable that the piezoelectric vibrating member is a longitudinal-mode piezoelectric vibrating member. Of course, a bending-mode piezoelectric vibrating member can be also used.

In addition, the invention is a controlling unit that controls a liquid ejecting apparatus including: a pressure-generating chamber having an inside space whose volume is changeable, into which a liquid is supplied and which is communicated with a nozzle, a resonance frequency of said pressure-generating chamber having a period of Tc; and a pressure-generating unit that causes the pressure-generating chamber to expand and contract, based on a driving signal; comprising: a signal-generating unit that generates a driving signal including: a first signal-element for causing the pressure-generating chamber to expand, a second signal-element for causing the pressure-generating chamber to contract from an expanding state thereof in order to eject a drop of the liquid through the nozzle, and a third signal-element for causing the pressure-generating chamber to expand to an original state before outputting the first signal-element after the drop of the liquid is ejected; wherein the third signal-element includes: a first-step element for causing the pressure-generating chamber to expand to an intermediate contracting state, which is smaller than the original state before outputting the first signal-element, and a second-step element for causing the pressure-generating chamber of the intermediate contracting state to the original state before outputting the first signal-element, and the first-step element and the second-step element are substantially discontinuous in at least one of applying time or inclination.

A computer system can materialize the controlling unit or each component in the controlling unit.

This invention includes a storage unit capable of being read by a computer, storing a program for materializing each unit or each component in a computer system. This invention also includes the program itself for materializing each unit or each component in the computer system.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

Figure 1:
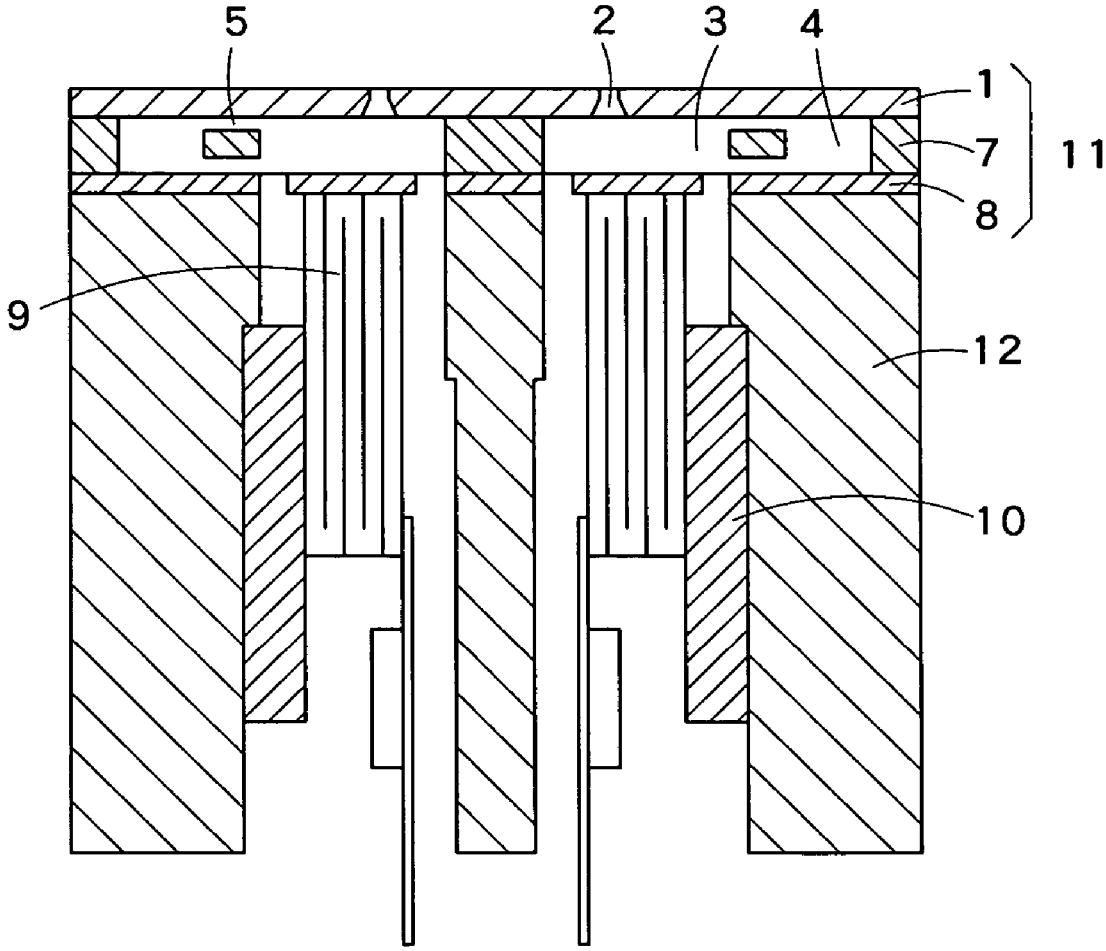
FIG. 1 is a sectional view of an example of recording head used in an ink-ejecting recording apparatus according to the invention.

FIG. 1 shows an example of recording head used in an ink-ejecting recording apparatus (a kind of liquid ejecting apparatus) of an embodiment according to the invention. The recording head shown in FIG. 1 mainly consists of an ink-way unit 11 having nozzles 2 and pressure-generating chambers 3 and a head-case 12 accommodating piezoelectric vibrating members 9. The ink-way unit 11 and the head-case 12 are joined to each other.

As shown in FIG. 1, the ink-way unit 11 is formed by stacked (layered) nozzle plate 1, way-forming plate 7 and elastic plate 8. The nozzles 2 are formed through the nozzle plate 1. Correspondingly to the respective nozzles 2, the way-forming plate 7 includes a space corresponding to the pressure-generating chambers 3, common ink reservoirs 4 and ink supplying ways 5 connecting the pressure-generating chambers 3 and the common ink reservoirs 4. The elastic plate 8 defines at least a part of the pressure-generating chambers 3.

The piezoelectric vibrating member 9 consists of a piezoelectric material and an electric conductive layer, which are alternatively stacked in parallel to a longitudinal direction thereof. Thus, the piezoelectric vibrating member 9 can contract in the longitudinal direction thereof when the piezoelectric vibrating member 9 is charged. In addition, the piezoelectric vibrating member 9 can return to an original state thereof (extend from a contracting state in the longitudinal direction) when the piezoelectric vibrating member 9 is discharged. That is, the piezoelectric vibrating member 9 is a longitudinal-mode piezoelectric vibrating member. A movable end of the piezoelectric vibrating member 9 is joined to a part of the elastic plate 8 that defines a part of a corresponding pressure-generating chamber 3, and the other end is fixed to the head-case 12 via a base member 10.

In such a recording head, a pressure-generating chamber 3 can expand and contract by causing a corresponding piezoelectric vibrating member 9 to contract and extend. Thus, a pressure of ink in the pressure-generating chamber 3 can be changed so that the ink can be supplied into the pressure-generating chamber 3 and a drop of the ink can be ejected through a corresponding nozzle 2.

In such an ink-ejecting recording head as described above, a Helmholtz resonance frequency FH of the pressure-generating chamber 3 can be represented by the following expression.

$$FH=1/(2\pi)\times\{(Mn+Ms)/[(Ci+Cv)\times(Mn\times Ms)]\}^{1/2}$$

Herein, Ci means a fluid compliance affected by a compressive character of the ink in the pressure-generating chamber 3. Cv means a solid compliance of the material itself of the elastic plate 8, the nozzle plate 1 or the like forming the pressure-generating chamber 3. Mn means an inertance of the nozzle 2, and Ms means an inertance of the ink supplying way 5.

A period Tc of the Helmholtz resonance frequency can be represented by a reciprocal of the Helmholtz resonance frequency FH (Tc=1/FH).

When a volume of the pressure-generating chamber 3 is represented by V, a density of the ink is represented by ρ and a speed of sound in the ink is represented by c, the fluid compliance Ci can be represented by the following expression.

$$Ci=V/(\rho\times c^2)$$

In addition, the solid compliance Cv of the pressure-generating chamber 3 corresponds to a static deforming rate of the pressure-generating chamber 3 when a unit of pressure is applied to the pressure-generating chamber 3.

In detail, for example, when the pressure-generating chamber 3 has a length of 0.5 mm to 2 mm, a width of 0.1 mm to 0.2 mm and a depth of 0.05 mm to 0.3 mm, the Helmholtz resonance frequency FH is in a range of 50 kHz to 200 kHz, that is, the period Tc of the Helmholtz resonance frequency is in a range of 5 μsec to 20 μsec. In more detail, for example, when the solid compliance Cv is $7.5\times10^{-21}$

[$m^5$/N], the liquid compliance Ci is $5.5\times10^{-21}$ [$m^5$/N], the inertance Mn of the nozzle 2 is $1.5\times10^8$ [Kg/$m^4$] and the inertance Ms of the ink supplying way 5 is $3.5\times10^8$ [Kg/$m^4$], the Hermholtz resonance frequency FH is 136 kHz, that is, the period Tc of the Hermholtz resonance frequency is 7.3 μsec.

Figure 2:
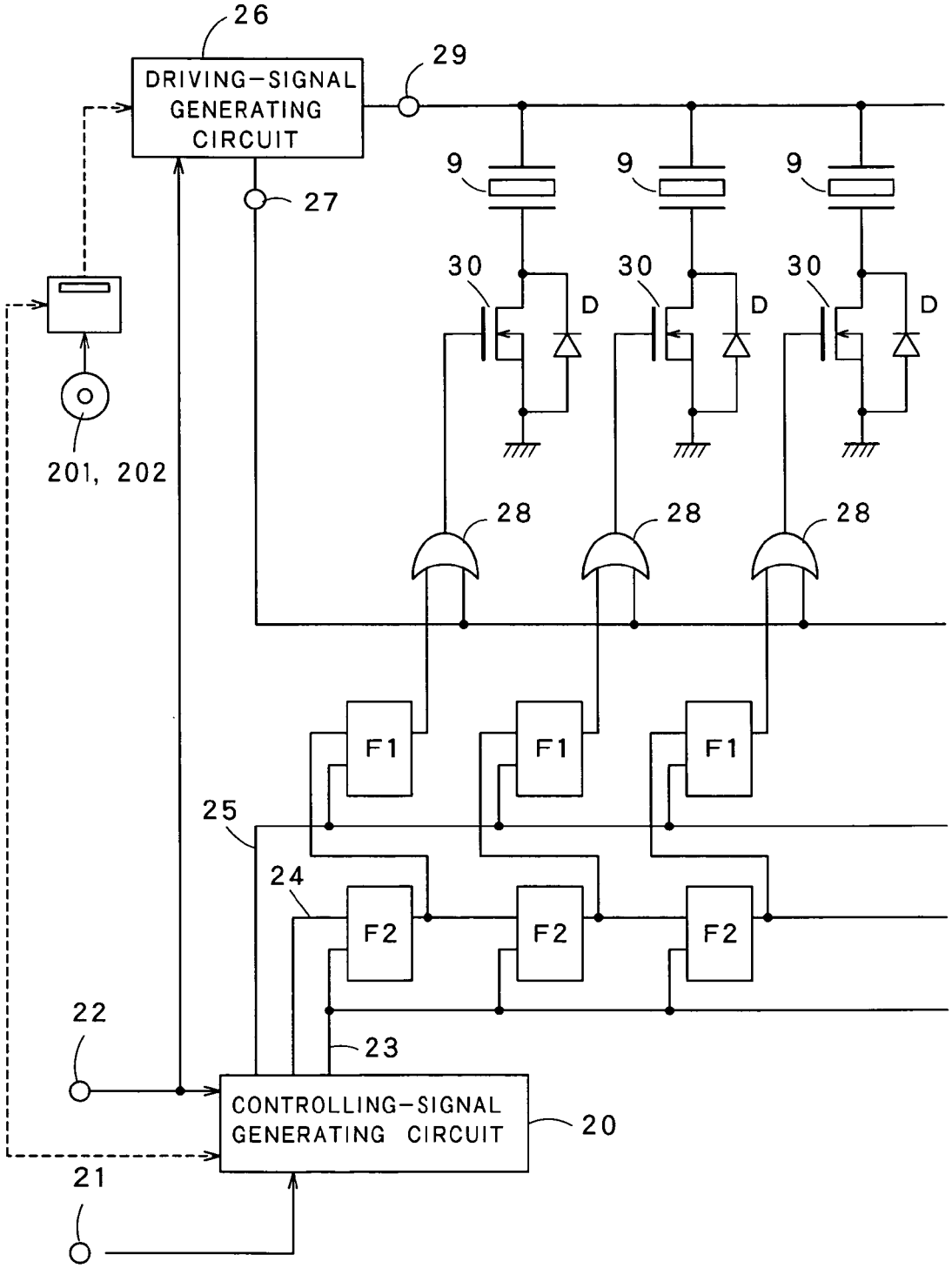
FIG. 2 is a block diagram of an example of driving circuit for the recording head shown in FIG. 1.

FIG. 2 shows an example of driving circuit for driving the above recording head. As shown in FIG. 2, a controlling-signal generating circuit 20 has input terminals 21 and 22 and output terminals 23, 24 and 25. A printing signal and a timing signal are adapted to be inputted to the input terminals 21 and 22, respectively, from an outside unit which can generate printing data. A shift-clock signal, a printing signal and a latch signal are adapted to be outputted from the output terminals 23, 24 and 25, respectively.

A driving-signal generating circuit 26 is adapted to output a driving signal for driving the piezoelectric vibrating members 9, based on the timing signal from the outside unit that is similar to the signal inputted to the input terminal 22.

F1 represents a flip-flop circuit functioning as a latch circuit. F2 represents a flip-flop circuit functioning as a shift register. If signals outputted from the flip-flop circuits F2 correspondingly to the respective piezoelectric vibrating members 9 are latched by the flip-flop circuits F1, selecting signals are outputted to respective switching transistors 30 via OR gates 28.

Figure 3:
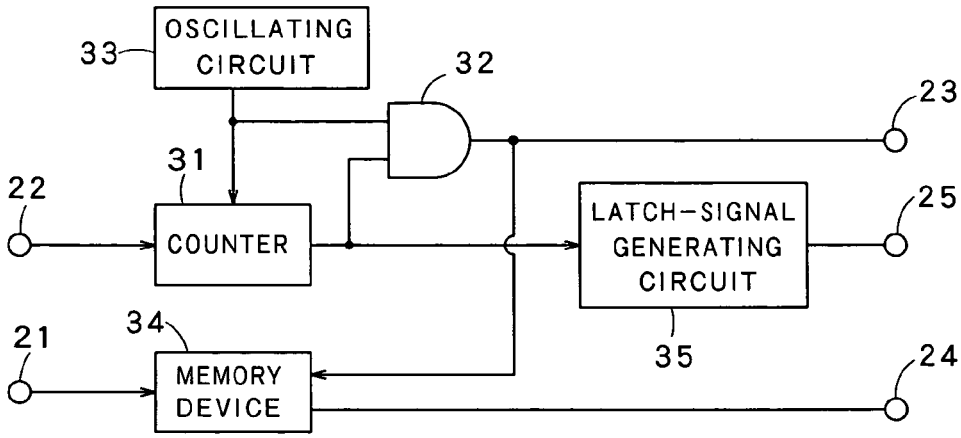
FIG. 3 is a block diagram of an example of the controlling-signal generating circuit shown in FIG. 2.

FIG. 3 shows an example of the controlling-signal generating circuit 20. A counter 31 is adapted to be initialized just when the timing signal inputted through the input terminal 22 rises up. After the counter 31 is initialized, the counter 31 starts to count clock-signals from an oscillating circuit 33. When a counted value reaches a number of the piezoelectric vibrating members 9 connected to an output terminal 29 of the driving-signal generating circuit 26 (a number of the pressure-generating chambers 3 capable of being deformed), the counter 31 is adapted to output a carry-signal being a Low level and stop counting. An AND gate 32 makes a logical product of the carry-signal from the counter 31 and the clock-signal from the oscillating circuit 33. The logical product is outputted to the output terminal 23 as the shift-clock signal.

A memory device 34 is adapted to store the printing data including the same number of bits as the piezoelectric vibrating members 9. The printing data is adapted to be inputted through the input terminal 21. The memory device 34 has a function to output the printing data stored therein in a serial manner i.e. bit by bit to the output terminal 24, synchronously with the signal from the AND gate 32.

The printing signal serially transmitted from the output terminal 24 is latched by the flip-flop circuits F2 (shift registers) based on the shift-clock signal outputted from the output terminal 23, in order to become selecting signals for the switching transistors 30 for the next printing period. Latch signals are outputted from a latch-signal generating circuit 35, synchronously with the carry-signal being a Low level from the counter 31. The latch signals are outputted at a point of time when the driving signal maintains a medium voltage VM.

Figure 4:
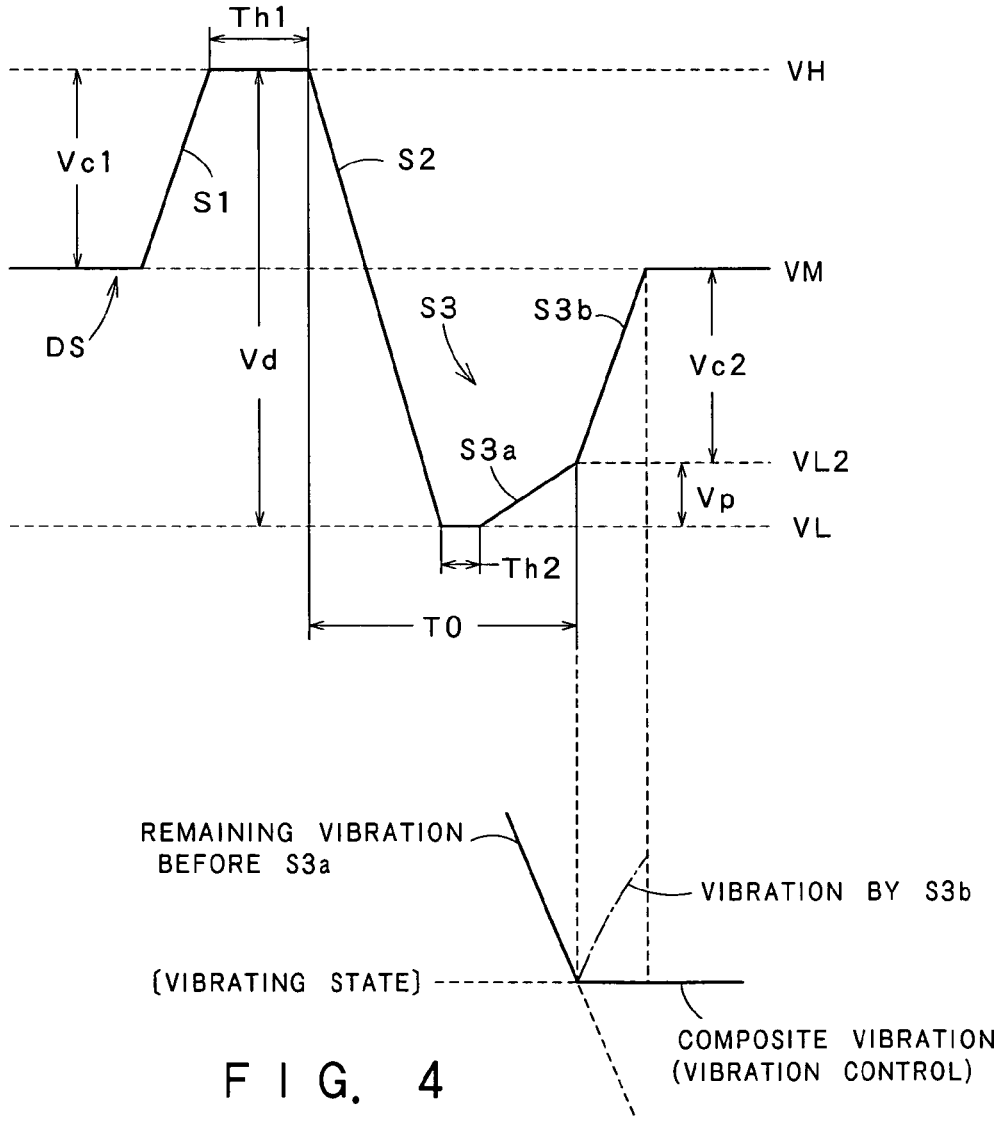
FIG. 4 is a graph of an example of driving signal according to the invention.

FIG. 4 shows an example of driving signal DS generated by the driving-signal generating circuit 26. Any known signal-generating circuit may be used as the driving-signal generating circuit 26.

As shown in FIG. 4, the driving signal DS is a driving signal that rises up from a medium voltage VM to a voltage VH at a constant inclination, holds the voltage VH for a certain time Th1, falls down to a voltage VL at a constant inclination, holds the voltage VL for a certain time Th2, rises up again to a contracting-medium voltage VL2 at a low constant inclination, and then rises up to the medium voltage VM at a higher constant inclination.

The charging signal-element S1 that rises up from the medium voltage VM to the voltage VH at the constant inclination is the first signal-element of the invention. The amplitude (voltage difference) Vc1 of the first signal-element S1 is VH−VM.

The discharging signal-element S2 that falls down from the voltage VH to the voltage VL at the constant inclination is the second signal-element of the invention. The amplitude (voltage difference) Vd of the second signal-element S2 is VH−VL.

The charging signal-element S3*a* that rises up from the voltage VL to the contracting-middle voltage VL2 at the low constant inclination is the first-step element of the third signal-element S3 of the invention. The amplitude (voltage difference) Vp of the first-step element S3*a* of the third signal-element S3 is VL2−VL.

The charging signal-element S3*b* that rises up from the contracting-middle voltage VL2 to the middle voltage at the higher constant inclination than the first-step element S3*a* is the second-step element of the third signal-element S3 of the invention. The amplitude (voltage difference) Vc2 of the second-step element S3*b* of the third signal-element S3 is VM−VL2.

The amplitude (voltage difference) Vd of the second signal-element S2 is designed based on desired ejecting characteristics of the drops of the ink. On the other hand, the amplitude (voltage difference) Vc2 of the second-step element S3*b* is designed for suitably controlling the vibrations of the menisci. As confirmed through various experiments by the inventors, it is preferable that the amplitude Vc2 of the second-step element S3*b* of the third signal-element S3 is more than 20% of the amplitude Vd of the second signal-element S2. Then, the amplitude (voltage difference) Vc1 of the first signal-element S1 is designed based on a balance between an ejecting speed of the drop of the ink and a time of one period of the driving signal DS (frequency). As confirmed through various experiments by the inventors, it is preferable that the amplitude Vc1 of the first signal-element S1 is less than 50% of the amplitude Vd of the second signal-element S2. Then, the first-step element S3*a* of the low inclination is inserted for the adjustment of the voltage level.

As described above, expansion of the pressure-generating chamber while the third signal-element S3 is applied (outputted) is conducted by two steps. Thus, if the expansion step of the pressure-generating chamber by the latter step i.e. the second-step element S3*b* is designed for controlling the vibrations of the menisci, the voltage level can be adjusted by means of the former step i.e. the first-step element S3*a*, that is, the design of the first signal-element S1 is not affected.

Thus, the driving signal DS achieves stableness of behavior of a satellite drop and a suitable ejecting speed of the drop of the liquid, and can be used in a drive at a high frequency. In addition, according to the driving signal DS, generation of cross-talk can be also inhibited.

In addition, in the embodiment, the amplitude Vp of the first-step element S3*a* of the third signal-element S3 is less than 40% of the amplitude Vd of the second signal-element S2, and equal to or less than the amplitude Vc2 of the second-step element S3*b* of the third signal-element S3.

As described above, the first-step element S3*a* of the third signal-element S3 is an element used for the adjustment of the voltage level. However, when vibrations that are caused by the application of the first-step element S3*a* become large, behaviors of the menisci become also unstable. Regarding this matter, the inventors have found through various experiments that: regarding the first-step element S3*a* of the third signal-element S3, lower inclination is more preferable, although too low inclination may elongate the period of the driving signal; and regarding the amplitude Vp, it is preferably less than 40% of the amplitude Vd of the second signal-element S2 and/or equal to or less than the amplitude Vc2 of the second-step element S3*b* of the third signal-element S3.

Then, an operation of the above structured apparatus is explained. As described above, the controlling-signal generating circuit 20 transmits the selecting signals for the switching transistors 30 to the flip-flop circuits F1 during a prior printing period. The selecting signals are latched by the flip-flop circuits F1 while all of the piezoelectric vibrating members 9 are charged to the medium voltage VM. Then, when the timing signal is inputted, the driving signal DS shown in FIG. 4 rises up from the medium voltage VM to the voltage VH (the first charging signal-element S1). Thus, selected piezoelectric vibrating members 9 are charged to contract at a substantially constant speed, so that the corresponding pressure-generating chambers 3 are caused to expand.

When the pressure-generating chambers 3 expand, the ink in the corresponding common ink reservoirs 4 flow into the pressure-generating chambers 3 through the corresponding ink supplying ways 5. At the same time, the meniscuses in the corresponding nozzles 2 are pulled toward the respective pressure-generating chambers 3. When the driving signal reaches the voltage VH, the voltage VH is maintained for the predetermined time Th1. Then, the driving signal falls down to the voltage VL (the second discharging signal-element S2).

When the driving signal falls down to the voltage VL, electric charges of the piezoelectric vibrating members 9, which is charged to the voltage VH, are discharged via respective diodes D. Thus, the piezoelectric vibrating members 9 extend, so that the corresponding pressure-generating chambers 3 are caused to contract. Then, the ink in the pressure-generating chambers 3 is pressed, and drops of the ink are ejected from the corresponding nozzles 2, respectively.

In addition, the driving signal DS rises up again from the voltage VL to the contracting-medium voltage VL2 (the first-step element S3*a* of the third charging signal-element S3). Thus, the piezoelectric vibrating members 9 are charged again so that the pressure-generating chambers 3 minutely expand. Herein, the magnitude of the expansion is minute, and the speed of the expansion is low.

Then, the driving signal DS rises up again from the contracting-medium voltage VL2 to the medium voltage VM (the second-step element S3*b* of the third charging signal-element S3). Thus, the piezoelectric vibrating members 9 are further charged so that the pressure-generating chambers 3 expand. At that time, the second-step element S3*b* is outputted in reverse phase with the remaining vibrations of the pressure-generating chambers 3 (see FIG. 4). Thus, the meniscuses, which are going to start moving toward the nozzles 2, are pulled back toward the respective pressure-generating chambers 3. Thus, kinetic energy of the meniscuses may be reduced so much that the vibrations of the meniscuses may be damped rapidly.

As described above, according to the above ink-ejecting recording apparatus, since the expansion of the pressure-generating chamber while the third signal-element S3 is applied (outputted) is conducted by two steps, the driving signal achieves the stableness of behavior of a satellite drop and the suitable ejecting speed of the drop of the liquid, and may be used in a drive at a high frequency. Thus, the above ink-ejecting recording apparatus can eject a drop of liquid more stably and can be driven at a high frequency.

Especially, since the first-step element S3*a* and the second-step element S3*b* of the third charging signal-element S3 are continuous, by reducing the inclination of the first-step element S3*a* as much as possible in order to soften the expansion of the pressure-generating chambers 3 caused by the first-step element S3*a*, the effect of controlling the vibrations of the menisci can be achieved more efficiently.

Figure 5:
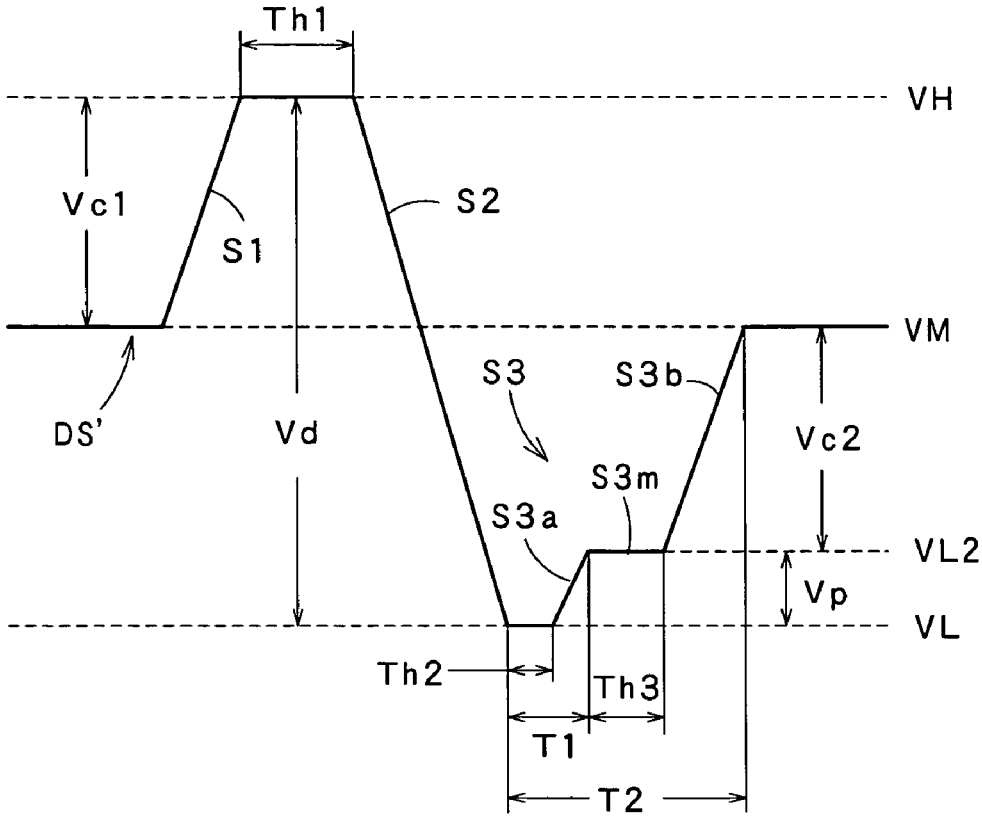
FIG. 5 is a graph of another example of driving signal according to the invention.

Then, FIG. 5 shows another example of driving signal generated by the driving-signal generating circuit 26.

As shown in FIG. 5, the driving signal DS' is a driving signal that rises up from a medium voltage VM to a voltage VH at a constant inclination, holds the voltage VH for a certain time Th1, falls down to a voltage VL at a constant inclination, holds the voltage VL for a certain time Th2, rises up again to a contracting-medium voltage VL2 at a constant inclination, holds the voltage VL2 for a certain time Th3, and then rises up to the medium voltage VM at a constant inclination.

The charging signal-element S1 that rises up from the medium voltage VM to the voltage VH at the constant inclination is the first signal-element of the invention. The amplitude (voltage difference) Vc1 of the first signal-element S1 is VH−VM.

The discharging signal-element S2 that falls down from the voltage VH to the voltage VL at the constant inclination is the second signal-element of the invention. The amplitude (voltage difference) Vd of the second signal-element S2 is VH−VL.

The charging signal-element S3*a* that rises up from the voltage VL to the contracting-middle voltage VL2 at the constant inclination is the first-step element of the third signal-element S3 of the invention. The amplitude (voltage difference) Vp of the first-step element S3*a* of the third signal-element S3 is VL2−VL.

The charging signal-element S3*b* that rises up from the contracting-middle voltage VL2 to the middle voltage at the constant inclination is the second-step element of the third signal-element S3 of the invention. The amplitude (voltage difference) Vc2 of the second-step element S3*b* of the third signal-element S3 is VM−VL2.

In addition, the signal-element that holds the voltage VL2 for the certain time is the middle-step element S3*m* of the third signal-element S3 of the invention.

The amplitude (voltage difference) Vd of the second signal-element S2 is designed based on desired ejecting characteristics of the drops of the ink. On the other hand, the amplitude (voltage difference) Vc2 of the second-step element S3*b* is designed for suitably controlling the vibrations of the menisci. Then, the amplitude (voltage difference) Vc1 of the first signal-element S1 is designed based on a balance between an ejecting speed of the drop of the ink and a time of one period of the driving signal DS' (frequency). Then, the first-step element S3*a* is inserted for the adjustment of the voltage level.

As described above, expansion of the pressure-generating chamber while the third signal-element S3 is applied (outputted) is conducted by two steps. Thus, if the expansion step of the pressure-generating chamber by the latter step i.e. the second-step element S3*b* is designed for controlling the vibrations of the menisci, the voltage level can be adjusted by means of the former step i.e. the first-step element S3*a*, that is, the design of the first signal-element S1 is not affected.

Thus, the driving signal DS' achieves stableness of movement of a satellite drop and a suitable ejecting speed of the drop of the liquid, and can be used in a drive at a high frequency. In addition, according to the driving signal DS', generation of cross-talk can be also inhibited.

Herein, the time Th2 for which the voltage VL is held, that is, the time Th2 from an end time of outputting of the second signal-element S2 to a start time of outputting of the first-step element S3*a* of the third signal-element S3 is equal to or more than 0.6 μs, in order to satisfy structural request of the driving-signal generating circuit 26.

In addition, in the embodiment, a time T1 from the end time of outputting of the second signal-element S2 to an end time of outputting of the first-step element S3*a* of the third signal-element S3 and a time T2 from the end time of outputting of the second signal-element S2 to an end time of outputting of the second-step element S3*b* of the third signal-element S3 satisfy a relationship of $T1 \approx T2 \times 1/4$.

Specifically, Th2=0.6 μs, S3*a*=1.0 μs, Th3=2.8 μs and S3*b*=2.3 μs when Tc=7.3 μs.

In addition, the time T2 is set to be substantially equal to the period Tc of the resonance frequency of the inside space of the pressure-generating chamber. Thus, the vibrations can be effectively controlled.

Herein, explained is a relationship between the time T1 from the end time of outputting of the second signal-element S2 to the end time of outputting of the first-step element S3*a* of the third signal-element S3 and the time T2 from the end time of outputting of the second signal-element S2 to the end time of outputting of the second-step element S3*b* of the third signal-element S3.

If a relationship of $T1 \approx T2 \times 1/2$ is satisfied between the times T1 and T2, application (outputting) of the first-step element urges further vibrations of the menisci. Thus, it is preferable that a relationship of $T1 \neq T2 \times 1/2$ is satisfied between the times T1 and T2.

Figure 6:
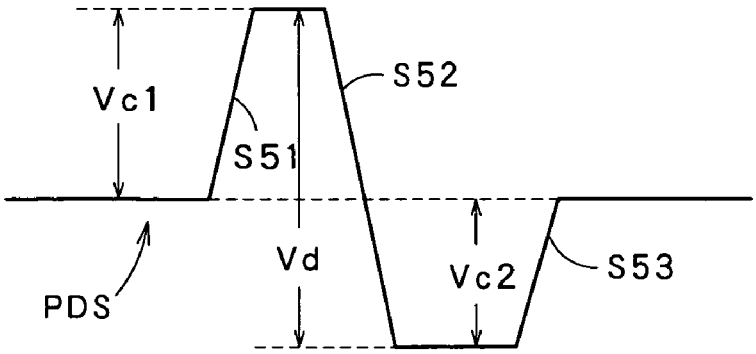
FIG. 6 is a graph of an example of conventional driving signal.

In addition, as confirmed through various experiments by the inventors, it is preferable that a relationship of $T1 < T2 \times 1/2$ is satisfied between the times T1 and T2 . More preferably, a relationship of $T1 \leqq T2 \times 1/4$ is satisfied. Even if a relationship of $T1 > T2 \times 1/2$ is satisfied between the times T1 and T2, effectiveness of the invention may be confirmed. However, the level of the effectiveness is not so great compared with a conventional example (see FIG. 6) wherein the first-step element S3*a* and the second-step element S3*b* are continuous and have the same inclination (wherein expansion of the pressure-generating chambers by means of the second-step element S3*b* is started continuously to a state of the pressure-generating chambers just before applying the second-step element S3*b*).

In addition, in the embodiment, the amplitude Vp of the first-step element S3*a* of the third signal-element S3 is 15% of the amplitude Vd of the second signal-element S2.

As described above, the first-step element S3*a* of the third signal-element S3 is an element used for the adjustment of the voltage level. However, regarding the vibrations caused by application of the first-step element S3*a*, no particular positive vibration control is taken into consideration. Thus, if such vibrations have a significant magnitude, behaviors of the menisci become unstable.

The inventors have found through various experiments that: it is preferable that the amplitude Vp of the first-step element S3*a* of the third signal-element S3 is equal to or less than 20%, in particular 15%, of the amplitude Vd of the second signal-element S2.

Then, an operation of the apparatus using the above driving signal DS' is explained. As described above, the controlling-signal generating circuit 20 transmits the selecting signals for the switching transistors 30 to the flip-flop circuits F1 during a prior printing period. The selecting signals are latched by the flip-flop circuits F1 while all of the piezoelectric vibrating members 9 are charged to the medium voltage VM. Then, when the timing signal is inputted, the driving signal DS' shown in FIG. 5 rises up from the medium voltage VM to the voltage VH (the first charging signal-element S1). Thus, selected piezoelectric vibrating members 9 are charged to contract at a substantially constant speed, so that the corresponding pressure-generating chambers 3 are caused to expand.

When the pressure-generating chambers 3 expand, the ink in the corresponding common ink reservoirs 4 flow into the pressure-generating chambers 3 through the corresponding ink supplying ways 5. At the same time, the meniscuses in the corresponding nozzles 2 are pulled toward the respective pressure-generating chambers 3. When the driving signal reaches the voltage VH, the voltage VH is maintained for the predetermined time Th1. Then, the driving signal falls down to the voltage VL (the second discharging signal-element S2).

When the driving signal falls down to the voltage VL, electric charges of the piezoelectric vibrating members 9, which is charged to the voltage VH, are discharged via respective diodes D. Thus, the piezoelectric vibrating members 9 extend, so that the corresponding pressure-generating chambers 3 are caused to contract. Then, the ink in the pressure-generating chambers 3 is pressed, and drops of the ink are ejected from the corresponding nozzles 2, respectively.

In addition, the driving signal DS' rises up again from the voltage VL to the contracting-medium voltage VL2 (the first-step element S3*a* of the third charging signal-element S3). Thus, the piezoelectric vibrating members 9 are charged again so that the pressure-generating chambers 3 minutely expand. Herein, the magnitude of the expansion is minute.

Then, the driving signal DS' rises up again from the contracting-medium voltage VL2 to the medium voltage VM (the second-step element S3*b* of the third charging signal-element S3). Thus, the piezoelectric vibrating members 9 are further charged so that the pressure-generating chambers 3 expand. At that time, the second-step element S3*b* is outputted in reverse phase with the remaining vibrations of the pressure-generating chambers 3. Thus, the meniscuses, which are going to start moving toward the nozzles 2, are pulled back toward the respective pressure-generating chambers 3. Thus, kinetic energy of the meniscuses may be reduced so much that the vibrations of the meniscuses may be damped rapidly.

As described above, according to the driving signal DS' as well, the expansion of the pressure-generating chamber while the third signal-element S3 is applied (outputted) is conducted by two steps, so that the stableness of behavior of a satellite drop and the suitable ejecting speed of the drop of the liquid can be achieved. In addition, the driving signal DS' may be also used in a drive at a high frequency. Thus, the above ink-ejecting recording apparatus can eject a drop of liquid more stably and can be driven at a high frequency.

In addition, the controlling-signal generating circuit 20, the driving-signal generating circuit 26 or the like can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program, are intended to be protected by this application.

Each of the storage units 201 and 202 can be not only a substantial object such as a floppy disk or the like, but also a network for transmitting various signals.

As the piezoelectric vibrating members, bending-mode piezoelectric vibrating members may be also used. The bending-mode piezoelectric vibrating members are charged to deform so as to cause the pressure chambers to contract, and discharged to deform so as to cause the pressure chambers to expand. In the case, up-and-down (positive and negative) relationship of waveform supplied to the piezoelectric vibrating members becomes opposite from the case of longitudinal-mode piezoelectric vibrating members.

The above description is given for the ink-ejecting recording apparatus. However, this invention is intended to apply to general liquid ejecting apparatuses widely. A liquid may be glue, nail polish or the like, instead of the ink.

What is claimed is:

1. A liquid ejecting apparatus comprising:

a pressure-generating chamber having an inside space whose volume is changeable, into which a liquid is supplied and which is communicated with a nozzle, a resonance frequency of said pressure-generating chamber having a period of Tc, a signal-generating unit that generates a driving signal including: a first signal-element for causing the pressure-generating chamber to expand, a second signal-element for causing the pressure-generating chamber to contract from an expanding state thereof in order to eject a drop of the liquid through the nozzle, and a third signal-element for causing the pressure-generating chamber to expand to an original state before outputting the first signal-element after the drop of the liquid is ejected, and a pressure-generating unit that causes the pressure-generating chamber to expand and contract, based on the driving signal, wherein the third signal-element includes:

a first-step element for causing the pressure-generating chamber to expand to an intermediate contracting state, which is smaller than the original state before outputting the first signal-element, and a second-step element for causing the pressure-generating chamber of the intermediate contracting state to the original state before outputting the first signal-element, and the first-step element and the second-step element are substantially discontinuous in at least one of applying time or inclination;

wherein a middle-step element for causing the pressure-generating chamber to maintain the intermediate contracting state is provided between the first-step element of the third signal-element and the second-step element of the third signal-element.

2. A liquid ejecting apparatus according to claim 1, wherein:

a time T1 from an end time of outputting of the second signal-element to an end time of outputting of the first-step element of the third signal-element and a time T2 from the end time of outputting of the second signal-element to an end time of outputting of the second-step element of the third signal-element satisfy a relationship of $T1<T2\times 1/2$.

3. A liquid ejecting apparatus according to claim 2, wherein:

the time T1 from the end time of outputting of the second signal-element to the end time of outputting of the first-step element of the third signal-element and the time T2 from the end time of outputting of the second signal-element to the end time of outputting of the second-step element of the third signal-element satisfy a relationship of $T1\leqq T2\times 1/4$.

4. A liquid ejecting apparatus according to claim 1, wherein:

a time T2 from an end time of outputting of the second signal-element to an end time of outputting of the second-step element of the third signal-element is set to be substantially equal to the period Tc of the resonance frequency of the inside space of the pressure-generating chamber.

5. A liquid ejecting apparatus according to claim 1, wherein:

a time T2 from an end time of outputting of the second signal-element to an end time of outputting of the second-step element of the third signal-element is set to be variable depending on the period Tc of the resonance frequency of the inside space of the pressure-generating chamber.

6. A liquid ejecting apparatus according to claim 1, wherein:

an amplitude Vp of the first-step element of the third signal-element is equal to or less than 20% of an amplitude Vd of the second signal-element.

7. A liquid ejecting apparatus according to claim 6, wherein:

an amplitude Vp of the first-step element of the third signal-element is equal to or less than 15% of an amplitude Vd of the second signal-element.

8. A liquid ejecting apparatus according to claim 1, wherein:

the pressure-generating unit has a longitudinal-mode piezoelectric vibrating member.

9. A controlling unit that controls a liquid ejecting apparatus including: a pressure-generating chamber having an inside space whose volume is changeable, into which a liquid is supplied and which is communicated with a nozzle, a resonance frequency of said pressure-generating chamber having a period of Tc; and a pressure-generating unit that causes the pressure-generating chamber to expand and contract, based on a driving signal; comprising:

a signal-generating unit that generates a driving signal including: a first signal-element for causing the pressure-generating chamber to expand, a second signal-element for causing the pressure-generating chamber to contract from an expanding state thereof in order to eject a drop of the liquid through the nozzle, and a third signal-element for causing the pressure-generating chamber to expand to an original state before outputting the first signal-element after the drop of the liquid is ejected, wherein the third signal-element includes:

a first-step element for causing the pressure-generating chamber to expand to an intermediate contracting state, which is smaller than the original state before outputting the first signal-element, and a second-step element for causing the pressure-generating chamber of the intermediate contracting state to the original state before outputting the first signal-element, and the first-step element and the second-step element are substantially discontinuous in at least one of applying time or inclination;

wherein a middle-step element for causing the pressure-generating chamber to maintain the intermediate contracting state is provided between the first-step element of the third signal-element and the second-step element of the third signal-element.

10. A controlling unit according to claim 9, wherein:

a time T1 from an end time of outputting of the second signal-element to an end time of outputting of the first-step element of the third signal-element and a time T2 from the end time of outputting of the second signal-element to an end time of outputting of the second-step element of the third signal-element satisfy a relationship of $T1<T2\times 1/2$.

11. A controlling unit according to claim 10, wherein:

the time T1 from the end time of outputting of the second signal-element to the end time of outputting of the first-step element of the third signal-element and the time T2 from the end time of outputting of the second signal-element to the end time of outputting of the second-step element of the third signal-element satisfy a relationship of $T1\leqq T2\times 1/4$.

12. A controlling unit according to claim 9, wherein:

a time T2 from an end time of outputting of the second signal-element to an end time of outputting of the second-step element of the third signal-element is set to be substantially equal to the period Tc of the resonance frequency of the inside space of the pressure-generating chamber.

13. A controlling unit according to claim 9, wherein:

a time T2 from an end time of outputting of the second signal-element to an end time of outputting of the second-step element of the third signal-element is set to be variable depending on the period Tc of the resonance frequency of the inside space of the pressure-generating chamber.

14. A controlling unit according to claim 9, wherein:

an amplitude Vp of the first-step element of the third signal-element is equal to or less than 20% of an amplitude Vd of the second signal-element.

15. A controlling unit according to claim 9, wherein:

an amplitude Vp of the first-step element of the third signal-element is equal to or less than 15% of an amplitude Vd of the second signal-element.

* * * * *